United States Patent [19]

Rookus

[11] 4,102,044

[45] Jul. 25, 1978

[54] DEVICE TO IMPROVE CUTTING ACTION OF ELECTRIC SHAVERS

[76] Inventor: James E. Rookus, 2902 Marshall SE. Apt. E-11, Grand Rapids, Mich. 49508

[21] Appl. No.: 778,232

[22] Filed: Mar. 16, 1977

[51] Int. Cl.[2] ..... B26B 19/42

[52] U.S. Cl. ..... 30/34.2; 30/43.92; 30/346.51

[58] Field of Search ..... 30/34.2, 43.91, 43.92, 30/346.51

[56] References Cited

U.S. PATENT DOCUMENTS

| | | | |
|---|---|---|---|
| 2,240,633 | 5/1941 | Testi | 30/43.92 X |
| 2,279,102 | 4/1942 | Altemus | 30/43.92 |
| 2,948,063 | 8/1960 | Jepson | 30/43.92 X |
| 3,088,205 | 5/1963 | Ellis | 30/346.51 X |

*Primary Examiner*—Gary L. Smith

*Attorney, Agent, or Firm*—Price, Heneveld, Huizenga & Cooper

[57] ABSTRACT

A hair trapping member for use in electric shavers is disclosed. The member is designed to be mounted on a shaver blade of the type having a recessed central trough-like channel and a plurality of laterally extending, closely spaced cutter bars on each side. The bars, lengthwise of the blade, are separated by laterally extending slots which open both through the sides of the blade and into the central channel. The hair trapping member has an elongated channel-like body element sized to seat in the central channel of the blade. A plurality of laterally projecting tongues extend from each side of the body element, one of the tongues being adapted to be received in each of the slots for trapping and holding hairs entering the slots.

14 Claims, 9 Drawing Figures

DEVICE TO IMPROVE CUTTING ACTION OF ELECTRIC SHAVERS

BACKGROUND OF THE INVENTION

While electric shavers are popular and have achieved considerable acceptance, they have not lived up to expectations, particularly from the standpoint of providing a close, smooth shave. Their acceptance, to a substantial extent, has been largely due to their convenience, lack of irritation of the skin, and the fact they can be used without the necessity of shaving creams and hot water applied to the face to soften the hairs. Basically, these same reasons have recommended their adoption by women. However, for many people, these advantages have been offset by the fact that the electric shaver has not provided the close shave that is possible with the conventional safety razor. For this reason, many people are still users of safety razors of one type or another.

It has been determined that the electric shavers' failure to provide a close cut or shave arises from the fact that the hairs, particularly in the case of a man's beard, are located in slight depressions in the skin which surround the base of the hair. Thus, even though the hair is shaved off at the general plane of the skin surface, a short stubble is left in the pocket which is readily felt when one passes one's hand over a newly shaved portion of the beard-producing skin that has been shaved with an electric shaver. Another problem arises from the fact that many hairs grow at an acute angle to the skin surface. These tend to flatten against the skin as the shaver approaches and are only partially shortened. Further, as the shaver approaches the hairs, it is necessarily pressed firmly against the skin which results in some of the hairs, which are normally erect, being pivoted into a position lying at an acute angle to the skin surface. When this occurs, the shaver passes over the hairs either without cutting them, or with only removing a portion of the exposed hair.

It has been determined that the problem can be significantly overcome by causing the hairs to pivot into an erected position while the skin is stretched by the shaver sufficiently to flatten out and thus eliminate the pockets or depressions surrounding the individual hairs. For this purpose, I have provided a panel specifically designed to raise the hair as it enters the shaving head of an electric shaver. This arrangement is disclosed in my U.S. Pat. No. 4,003,130 issued Jan. 18, 1977 entitled "HAIR RAISING PANEL FOR ELECTRIC SHAVERS." The panel's structure described in that patent provides a marked improvement over the prior art electric shavers. I have, however, discovered that I can obtain significantly improved results through the use of the present invention.

SUMMARY OF THE INVENTION

I have determined that a hair engaging and entrapping device can be placed within the grid of the reciprocating blade of the conventional electric shaver which will entrap, and positively hold, the individual hairs, such that they are positively positioned in the path of the reciprocating cutting blade. This invention is designed for use with an electric shaver in which the cutting blade is an elongated member designed for lengthwise reciprocation. The blade has an elongated, box-like body portion which is lengthwise recessed in the center. On each side, a plurality of spaced cutter bars are provided. The cutter bars extend laterally and their side edges form the cutting edges of the blade. The cutter bars are separated by laterally extending slots.

The invention is an elongated member having a continuous, spine-like central portion which seats in the recessed center portion of the cutter blade and has a plurality of oppositely extending fingers on each side. The fingers are designed to seat, one in each of the slots, and to extend substantially the full length of the slots slightly below the bottom surface of the cutter bars. The fingers are narrower than the slots, providing hair entrapping and holding spaces by which the hairs are positively locked into position where they cannot escape the cutting action of the reciprocating blade as it shears back and forth against the inside surface of the outer screen.

DETAILED DESCRIPTION OF THE PREFERRED EMBODIMENTS

Figure 1:
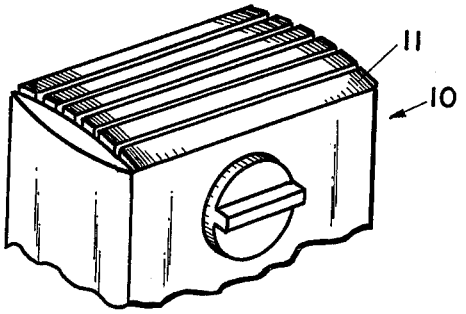
FIG. 1 is a fragmentary, oblique view of a conventional electric shaver having multiple cutting blades.
Figure 3:
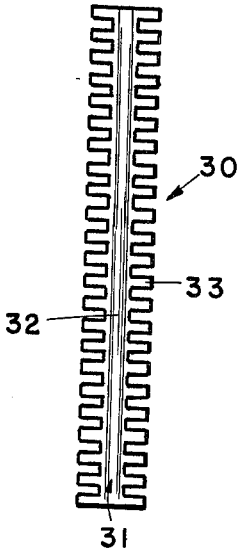
FIG. 3 is a plan view of the device of this invention.
Figure 2:
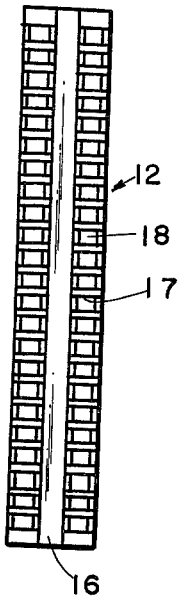
FIG. 2 is a plan view of a conventional cutter blade of the type used in the shaver illustrated in FIG. 1.

The numeral 10 refers to a conventional electric shaver of the type having elongated cutter blades mounted beneath a screen 11 and rapidly reciprocated lengthwise to shear the hairs that pass through the screen. The screen 11 is stationary and the cutter blade is mounted within the screen and, as it reciprocates, it is pressed against the inside surface of the screen. In the construction illustrated, the cutter blade 12 is a tubular member having a bottom 13, a pair of upstanding sides 14 and **14*a*, and a top 15. The top has an elongated, central, depressed section forming a central recessed channel 16 extending the full length of the blade. On each side of the channel, there are a plurality of laterally extending cutter bars 17 separated by slots 18. The slots 18 extend from the central channel to the outside of the cutter blade opening through the side walls 14 and 14*a* of the cutter blade and also into the channel 16. The edges of the cutter bars 17**, which define the walls of the slots, are sharpened and form the cutting edges which are effective in shearing the hairs as the blade is reciprocated. The structure thus far described is conventional.

Figure 4:
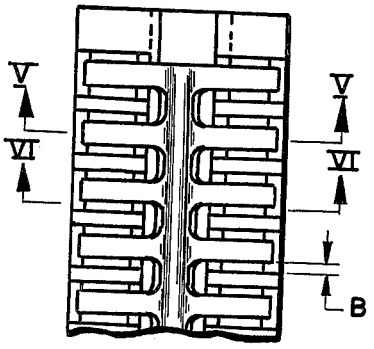
FIG. 4 is an enlarged, fragmentary plan view of the cutter blade illustrated in FIG. 3 with the hair entrapment member of this invention seated in the blade.
Figure 6:
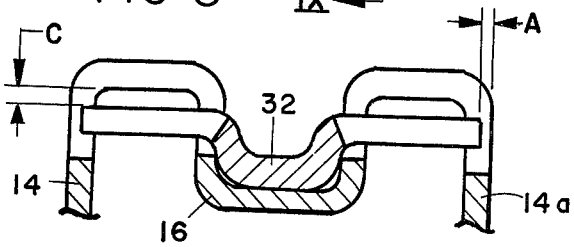
FIG. 6 is an enlarged, sectional, elevational view taken along the plane VI—VI of FIG. 4.

The hair entrapment member 30 has a main body portion 31 characterized by a recessed, elongated, central spine which forms a channel 32 extending the entire length of the member. The size and depth of the recess is such that the channel 32 will seat within the channel 16 of the blade. On each side of the channel 32 are laterally projecting tongues 33. The tongues 33 are so spaced that they will seat, one in each of the slots 18 of the blade. The number of tongues equals the number of slots on each side of the blade 12. The length of the tongues is such that, preferably, their outer ends are located intermediate the inner and outer faces of the side walls 14 and 14*a* of the blade. Preferably, the ends of the tongues are spaced inwardly from 0.001–0.015 of an inch inwardly of the outside face of the outer walls of the blade. This dimension is indicated by the dimension A in FIG. 6. The width of the tongues is less than that of the slots 18. The difference in width is preferably in the range of 0.003–0.010 of an inch and amounts to double that of the dimension B (FIG. 4). The depth of the central channel portion 32 is less than the depth of the channel in the blade so that the top surface of the tongues 33 is spaced below the inner surface of the top of the blade, preferably in the range of 0.005–0.010 of an inch. This spacing is indicated by the dimension C in FIG. 6. While these dimensions can be varied, it has been found that a member 30, constructed to these dimensions, has very satisfactory operating characteristics. The overall length of the member 30 is equal, or substantially equal, to the length of the blade 12.

A preferable material for the manufacture of the hair entrapping member 30 is 0.03–0.05 of an inch thick stainless steel. If there is sufficient room to receive the member, thicker material can be used.

Figure 7:
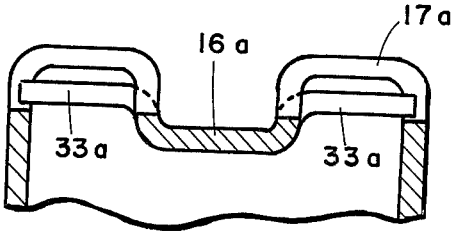
FIG. 7 is an enlarged, fragmentary, sectional view of a modified form of this invention taken along the plane VII—VII of FIG. 9.
Figure 5:
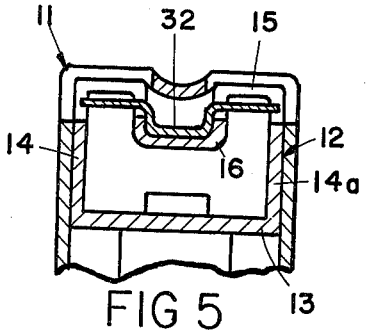
FIG. 5 is a sectional view taken along the plane V—V of FIG. 4.
Figure 8:
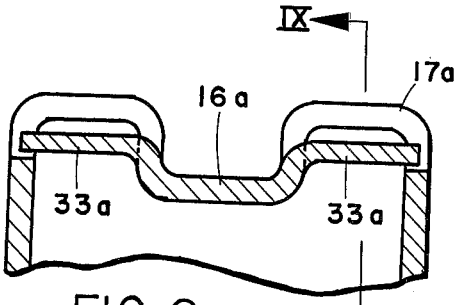
FIG. 8 is another enlarged, fragmentary, sectional view of the modified form of this invention taken on the plane VIII—VIII of FIG. 9.
Figure 9:
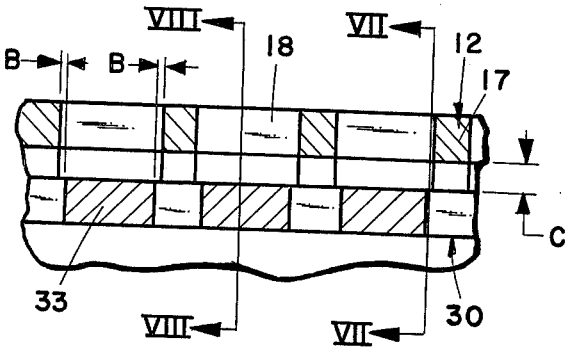
FIG. 9 is an enlarged, fragmentary, sectional view taken along the same plane IX—IX of FIG. 8.

The use of a separate member to increase the shaving efficiency of the equipment is preferable for existing shavers because, to improve the characteristics of an existing shaver, it is only necessary to seat one of the members 30 in place on each of the blades of a cutting head and restore the screens to their normal position. However, if the entire cutting blade is to be replaced, it is entirely possible to modify the cutting blade to make the hair entrapment tongues an integral part of the blade. This type of arrangement is suggested in FIGS. 7, 8 and 9. In this case, most of the metal normally removed from the cutting blade to form the slots, is relocated rather than removed. Enough metal is removed to create the spacing between the sides of the tongues and the edges of the cutter bars. Also, enough of the metal will be cut from the ends of the strips which are to form the tongues to reduce them to the desired length. The tongues will also be formed to offset them downwardly into the cutter blade such that their upper surfaces will be spaced from the lower or inside surfaces of the cutter bars. The values for each of the dimensions A, B and C given for the member 30 is retained in the modified construction. In this manner, a cutter blade will be formed having a central channel 16*a* and integral cutter bars 17*a* separted by slots which are occupied by integral tongues 33*a*. The function of the modified construction is the same as that of the two-component construction.

When a shaver is equipped with this invention, it has been observed that a much closer shave is obtained. It has been observed that if the conventional shaver of the type to which this invention can be attached is used to shave a beard, and the shaver is repeatedly passed over the skin surface so that it has an opportunity to shave as closely as possible, that there remains a small amount of beard which is detectable when one passes one's hand over the shaved area. The shaver is then cleaned so that there is no remaining hair entrapped in it and it is modified by adding the hair entrapment member of this invention. The previously shaved area is then reshaved. An inspection of the shaver will show that a significant quantity of additional hair has been removed because it is trapped within the head of the shaver. Also, by passing the hand over the reshaved area, it will be observed that the feel of any hair stubble has been removed. It has also been observed that some hours pass in the case of a normal beard before any feel of the existence of a beard returns. It is considered that this indicates a much closer and a more complete shave than was possible using the unmodified, conventional shaver. It has also been observed that the use of this invention does not interfere with the shaver's ability to shave a beard which has been allowed to grow for several days and, therefore, has relatively long hairs projecting above the skin surface.

While a preferred embodiment and a modification of this invention have been described, it will be recognized that various other modifications may be made without departing from the principle of the invention. Such of these modifications as incorporate the principle of the invention are to be considered as included hereinafter appended claims unless these claims, by their language, expressly state otherwise.

The embodiments of the invention in which an exclusive property or privilege is claimed are defined as follows:

1. In a shaver having a screen and an elongated blade and means to reciprocate the blade lengthwise, the blade having a top and sides and inner and outer surfaces and a plurality of closely spaced, parallel, elongated slots therein spaced apart by hair cutting members and extending normal to the axis of reciprocation of said blade and defining a plurality of spaced cutter bars; the center of said blade being recessed lengthwise to form an upwardly opening channel, the improvement comprising means for improving the cutting effeciency of said shaver, said means comprising: a body member having an elongated, central spine and a plurality of laterally extending tongues, the tongues being spaced to seat one in each of said slots; said central spine be adapted to seat in said channel; each of said tongues being narrower than the slot in which it is seated and the top thereof being below the lower surface of said cutter bars to define a hair receiving space in the path of the shearing action of said blade as it moves relative to said screen.

2. The means as described in claim 1 wherein the outer ends of said hair trapping means are located between the inner and outer surfaces of the sides of said blade.

3. The means as described in claim 1 wherein the spacing between the lower surface of said cutter bars and the top surface of said hair trapping means is in the range of 0.005 to 0.015 of an inch.

4. The means as described in claim 1 wherein said channel in said blade is midway between its sides and defines a pair of ridges, one on each side thereof; said slots being in said ridges and having one end opening through the side of said blade and an opposite end opening into said channel, said hair entrapping means being an inverted hat-shaped member in cross-section the outwardly extending portion of which forms said tongues.

5. In combination; a hair trapping element and an electric shaver having a screen and a lengthwise reciprocated blade bearing against the inside surface of the screen, the blade being elongated and having a plurality of laterally extending bars on each side spaced apart by slots, the bars having cutting edges on each side, said element comprising: a body having an elongated, central spine member, a plurality of laterally projecting tongues integral with and on each side of said member, said tongues being spaced to seat one in each of said slots; said tongues being narrower than said slots and of a length to extend laterally substantially to the outer surface wall of the blade.

6. The hair trapping element described in claim 5 wherein the width of said tongues is 0.006–0.020 of an inch less than the width of the slots.

7. The hair trapping element described in claim 6 wherein said member is offset at said spine to form a central, recessed channel extending lengthwise thereof, said tongues all being in a common plane.

8. In an electric shaver of the type having an elongated cutter blade and means to reciprocate it lengthwise, the blade having a plurality of spaced, laterally extending cutter bars separated by slots, the improvement comprising: a plurality of tongues, one seated in each of said slots and recessed below the lower surface of the cutter bars; the tongues each having a free end adjacent to the outer wall surface of the blade; the width of the tongues being less than that of the slots; the inner ends of the tongues securing them to the blade for reciprocation with the blade.

9. The improvement in electric shavers recited in claim 8 wherein the inner ends of the tongues are integral with the blade.

10. The improvement in electric shavers recited in claim 8 wherein a central spine is provided, said inner ends of said tongues being integral with said spine; said spine being secured to said blade for reciprocation therewith.

11. A blade assembly having an elongated blade of the lengthwise reciprocating type for an electric shaver and an outer screen against which said blade is seated, said blade having a plurality of laterally extending, parallel bars forming its upper face, said bars being spaced apart by slots; a hair entrapment member secured to said blade, said member having a plurality of tongues, one in each slot, said tongues all being co-planar in a plane offset below the lower surface of said bars; said tongues extending substantially the full length of said slots and being narrower than said slots for forming hair receiving openings on each side thereof immediately adjacent to said bars.

12. The blade described in claim 11 wherein said tongues are integral with said blade.

13. The blade described in claim 11 wherein an elongated element is secured to said blade; said tongues being integral with said element.

14. The blade described in claim 13 wherein said blade is centrally recessed to form a lengthwise, extending channel; said element being channel-shaped and seated in said channel of said blade.

* * * * *